US005478603A

United States Patent [19]

Smith

[11] Patent Number: 5,478,603

[45] Date of Patent: Dec. 26, 1995

[54] METHODS FOR IMPARTING STAIN-RESISTANCE TO POLYAMIDE AND WOOL TEXTILE PRODUCTS WHICH ARE LIGHTFAST AND DURABLE TO ALKALINE WASHING

[75] Inventor: Richard D. Smith, Opelika, Ala.

[73] Assignee: Westpoint Stevens Inc., West Point, Ga.

[21] Appl. No.: 215,986

[22] Filed: Mar. 22, 1994

Related U.S. Application Data

[62] Division of Ser. No. 989,485, Dec. 4, 1992, Pat. No. 5,328,766, which is a continuation of Ser. No. 847,412, Feb. 28, 1992, abandoned, which is a continuation of Ser. No. 543,997, Jun. 26, 1990, abandoned.

[51] Int. Cl.[6] ..... B05D 7/24; B05D 1/34; B05D 1/36

[52] U.S. Cl. ..... 427/393.4; 427/419.1; 427/412

[58] Field of Search ..... 427/393.4, 412, 427/419.1

[56] References Cited

U.S. PATENT DOCUMENTS

| | | | |
|---|---|---|---|
| 3,467,612 | 9/1969 | Gagliardi | 427/393.4 |
| 3,900,620 | 8/1975 | Gilman et al. | 427/408 |
| 3,918,901 | 11/1975 | Ida et al. | 8/552 |
| 3,961,123 | 6/1976 | Ohtomo | 428/224 |
| 4,244,906 | 1/1981 | Heinemann et al. | 264/109 |
| 4,822,373 | 4/1989 | Olson et al. | 8/115.6 |
| 4,875,901 | 10/1989 | Payet et al. | 8/115.56 |
| 5,074,883 | 12/1991 | Wang | 427/393.4 |
| 5,098,774 | 3/1992 | Chang | 8/560 |
| 5,212,272 | 5/1993 | Sargent et al. | 526/317.1 |
| 5,328,766 | 7/1994 | Smith | 428/378 |
| 5,356,689 | 10/1994 | Pechhold | 427/393.4 |
| 5,401,554 | 3/1994 | Armen | 427/393.4 |

*Primary Examiner*—Diana Dudash
*Attorney, Agent, or Firm*—Pennie & Edmonds

[57] ABSTRACT

This invention relates to an improved process for providing fibrous polyamide materials and wool materials with stain resistance and superior lightfastness that are more durable against alkaline washing. This is accomplished by treating the materials with an aqueous solution comprising a combination of a partially sulfonated novolak resin, methacrylic polymer and a soluble aluminum compound or a combination of a partially sulfonated novolak resin and a soluble aluminum compound.

8 Claims, No Drawings

METHODS FOR IMPARTING STAIN-RESISTANCE TO POLYAMIDE AND WOOL TEXTILE PRODUCTS WHICH ARE LIGHTFAST AND DURABLE TO ALKALINE WASHING

This is a divisional application of application Ser. No. 07/989,485, filed Dec. 4, 1992, now U.S. Pat. No. 5,328,766, which in turn is a continuation of application Ser. No. 07/847,412, filed Feb. 28, 1992, now abandoned, which in turn is a continuation of application Ser. No. 07/543,997, filed on Jun. 26, 1990, now abandoned.

1. INTRODUCTION

This invention relates to processes and compositions for providing polyamide products and woolen goods with stain resistance and lightfastness as compared to such products and goods treated by previously-known methods and formulations.

2. BACKGROUND OF THE INVENTION

A need has existed for fibrous polyamide and wool articles having properties of stain resistance to natural and artificial acid colorants and light-fastness that are more durable against alkaline washing than those currently available in the art. Several processes are known to impart stain resistance and lightfastness. For example, Olson et al., U.S. Pat. No. 4,822,373 (whose disclosure is incorporated herein by reference) describes treating polyamide fibers with an aqueous solution of a) a partially sulfonated Novolak resin and b) polymethacrylic acid, copolymers of methacrylic acid, or combinations of polymethacrylic acid and the copolymers of methacrylic acid. Such a treatment imparts stain resistance and lightfastness to the fibrous polyamide material. However, there remains a need to increase the durability of these stain resistance and lightfastness properties against the effects of aqueous alkaline solutions to which those materails are subjected during laundering.

3. SUMMARY OF THE INVENTION

The present invention provides fibrous polyamide and wool articles with improved resistance to staining by acid colorants and lightfastness properties wherein the fibrous polyamide substrate is treated with a formulation comprising:

a) a partially sulfonated novolak resin;

b) polymethacrylic acid, copolymers of methacrylic acid, or combinations of polymethacrylic acid and copolymers of methacrylic acid; and c) an effective amount of a water-soluble aluminum compound.

The present invention likewise provides for a treated polyamide fiber or wool substrate with improved resistance to staining by acid colorants and superior lightfastness wherein the substrate is treated with the above formulation.

The partially sulfonated Novolak resin of component a) can be a sulfonated condensation product of at least one phenolic compound and an aldehyde. By way of non-limiting exemplification, the condensation product can be devised from bis(hydroxyphenyl) sulfone and formaldehyde or acetaldehyde.

The copolymers of component b) include, for example, copolymers of methacrylic acid and a comonomer which is a monocarboxylic acid, a polycarboxylic acid, an anhydride, an unsubstituted or substituted ester or amide of a carboxylic acid or anhydride, a nitrile, a vinyl monomer, a vinylidene monomer, a monoolefinic or polyolefinic monomer, a heterocyclic monomer, or combinations thereof.

Representative comonomers include alkyl acrylates wherein the alkyl group has 1 to 4 alkyl carbon atoms, itaconic acid, sodium sulfostyrene, or sulfated castor oil.

Representative copolymers of component b) include a terpolymer of methacrylic acid, sodium sulfostyrene, and styrene; methacrylic acid, sulfated castor oil, and acrylic acid; and methacrylic acid, acrylic acid, and sulfated castor oil.

Preferably, the methacrylic acid comprises about 30 to 100 weight percent of the methacrylic acid copolymer of component b).

The weight average molecular weight and the number average molecular weight of the methacrylic polymer should be such that satisfactory stain resistance is provided by the polymer in combination with the partially sulfonated novolak resin and the soluble aluminum compound. Generally, the lower 90 weight percent of the methacrylic acid homopolymer or copolymer has a weight average molecular weight preferably in the range of about 2500 to about 250,000. Additionally, the lower 90 weight percent of said homopolymer or copolymer preferably has a number average molecular weight in the range of about 500 to about 20,000.

The relative amounts of sulfonated novolak resin, methacrylic polymer(s) and soluble aluminum compound in the composition of the present invention should be sufficient to provide commercially acceptable stain resistance and lightfastness to the polyamide or wool substrate to the desired degree of durability. Optimun amounts of these three constituents will vary depending on the nature of the substrate. When the substrate is nylon 66, the amount of sulfonated novolak resin used is preferably at least about 0.01 weight percent based on the weight of the substrate, the methacrylic polymer is used in an amount of at least about 0.06 weight percent, and the soluble aluminum compound is used in an amount of at least about 0.05 weight percent. Where the substrate is nylon 6 or wool, the sulfonated novolak resin is preferably used in an amount of at least about 0.03 weight percent, the methacrylic polymer is used in an amount of at least about 0.12 weight percent, and the soluble aluminum compound is used in an amount of at least about 0.05 weight percent based on the weight of the substrate.

The soluble aluminum compound in the composition and process of the present invention is preferably used in an amount of at least about 0.5 weight percent based on the weight of the fibrous substrate. Representative soluble aluminum compounds useful in imparting more durable stain resistance and lightfastness include but are not limited to hydrated aluminum sulfate, aluminum chloride, aluminum acetate and aluminum nitrate.

I have additionally and unexpectedly found that fibrous polyamide and wool articles can have greater stain resistance to natural and artificial acid colorants than those heretofore known when treated with the combination of a) a partially sulfonated novolak resin; and b) an effective amount of a soluble aluminum compound.

The absence of the methacrylic polymer component does not significantly decrease the stain resistance of the fibrous polyamide and wool articles, although there is a decrease in the lightfastness properties of the articles when the methacrylic polymer component is absent. However, for many applications of the articles where lightfastness is not important the treatment provides an economical means of imparting durable stain resistance.

Representative partially sulfonated novolak resins and soluble aluminum compounds are the same as those noted previously for the three-component combination. The amounts of sulfonated novolak resin and soluble aluminum compound used should be sufficient to provide the desired degree of stain resistance to the polyamide or wool substrate. Preferably, where the substrate is nylon 66, the amount of sulfonated novolak resin used is at least about 0.01 weight percent, and the soluble aluminum compound is used in an amount of at least about 0.05 weight percent based on the weight of the nylon substrate. Where the substrate is nylon 6 or wool, the sulfonated novolak resin is preferably present in an amount of at least about 0.03 weight percent, and the soluble aluminum compound is present in an amount of at least about 0.05 weight percent based on the weight of the substrate.

The method of treating the fibrous polyamide or wool substrate to impart more durable stain resistance to acid colorants and lightfastness properties may vary depending on how the treatment may best be incorporated in the conventional processing and treating operations. The substrate may be contacted with an aqueous treating solution comprising the necessary components. Alternatively, the substrate may be contacted sequentially with aqueous treating solutions containing the individual components. Furthermore, the fibrous polyamide or wool substrate can be treated with an aqueous treating solution in a continuous or a batch method. The continuous method or the so-called Flex Nip Steam Application Method allows for a high output of treated carpet wherein the carpet is treated with the aqueous treating solution under steam for a short period of time. The batch method or the so-called Exhaust Method allows the carpet to be treated with the aqueous treating solution under steam for a relatively longer period of time. The batch method thus usually results in a more stain resistant fibrous polyamide or wool substrate compared to that treated by the continuous method. The following examples discuss the results of substrates treated under both the continuous and batch methods.

4. EXAMPLES

The following non-limiting examples serve to illustrate the invention. In the following examples, all weights are based on the weight of each component in 1000 grams of bath solution.

The carpet samples used in the following staining test are white Nylon 6 carpet material untreated with any stain blocker solution.

Two methods of applying the stain blocker solution are used.

Stain blocker solutions can be applied onto the carpet using the so-called Flex Nip Steam application method. A 9" wide roll of carpet is immersed in a stain blocker solution, absorbing about 3.5 times its weight in solution. The wet carpet is then heated under steam at atmospheric pressure at or above 210° F. for about 2 minutes. Excess solution is then squeezed out with pad rolls. The carpet is then washed four successive times by immersing the carpet in cold water and then squeezing out the water with pad rolls. The carpet is finally dried in a regular clothes dryer.

The second method of applying the stain blocker solution which was used is the so-called Exhaust Method. In this method, a carpet sample is immersed in 1000 grams (1 liter) of water solution with the indicated amounts of additives and heated to 160° F. for 20 minutes. The carpet is removed, washed in tap water, spinned by a washer in the spin cycle and dried at 250° F. for 20 minutes in a forced air oven.

The staining test was performed using 10 ml of pre-sweetened cherry flavored Kool-Aid poured onto 1.5" diameter circle of carpet using a pipe having an ID of 1.5 diameter to contain the liquid. The Kool-Aid solution is allowed to remain on the test carpet sample for various periods from 1 hour to 24 hours at room temperature, i.e. about 22° C.

The sample is rinsed under running tap water, dried, and visually evaluated for staining using a graduated rating scale which ranges from 1 to 8 as discussed in U.S. Pat. No. 4,822,373, which is incorporated herein by reference. A scale of 1 represents no discernible removal of the red dye stain from the Kool-Aid solution and 8 represents complete removal of the red dye stain. In general, stain resistance of at least about 5 is satisfactory, at least about 7 is good, and 8 is excellent.

In order to determine how durable the stain resistant property of the carpet is, carpet samples treated with stain blocker solutions are cleaned using an alkaline detergent prior to the above staining test. The treated carpet sample is washed by using a Rinsenvac Model 85 carpet cleaner which delivers a diluted solution of carpet Magic #2 solution, a commercially available alkaline detergent carpet cleaning solution, onto the carpet at 140° F. and which subsequently removes the excess detergent solution by vacuuming. Five strokes across the carpet sample by the carpet cleaner is counted as one cleaning. The carpet is dried in a regular clothes drier. The staining test is subsequently performed using the previously described procedure.

In the examples, discoloration due to exposure of the treated sample to ultraviolet light, i.e., lightfastness is determined using AATCC Test Method 16E- 1978 with an exposure time of 40 hours to a Zenon arc lamp. The exposed sample is evaluated for yellowing using a graduated rating scale which ranges from 1 to 5, with a rating of 5 representing no yellowing. In general, a rating of at least 4 is satisfactory, at least 4.5 is excellent.

The additives used in treating the carpet test samples are as follows:

Sulfonated Phenolic resin solution containing about 40 weight percent resin in water.

Leukotan™ 1027, a commercially available methacrylic acid-based copolymer from Rohm & Haas having a weight average molecular weight of 9020 and the number average molecular weight of 2,910 for the lower 90 weight percent of the copolymers. The Leukotan 1027 solution is an acrylic emulsion containing 30 weight percent solids content.

FX-661, a commercially available aqueous solution from 3M of preblended sulfonated Novolak resin and acrylic polymer.

Hydrated magnesium sulfate, $MgSO_4.7H_2O$

Hydrated aluminum sulfate, $Al_2(SO_4)_3.16H_2O$

Sulfamic Acid, $SO_3NH_4$ in about 15% water solution

Chelene S, a commercially available EDTA solution from Dow Chemical which serves to chelate soluble metal cartons.

EXAMPLES 1 and 2

The following stain blocker formulations were applied to Nylon 6 carpet samples using the Flex Nip Steam application method.

TABLE I

| | Formulation A | Formulation B |
|---|---|---|
| Sulfonated Phenolic Resin Solution | 1.5 g | — |
| Leukotan ™ 1027 | 15.0 g | — |
| FX-661 | — | 20 g |
| $Al_2(SO_4)_3.16H_2O$ | 1.0 g | |
| $MgSO_4.7H_2O$ | 19 g | 38 g |
| Sulfamic Acid (15% solution) | 50.66 g | 50 g |
| Chelene S | 3.3 g | 3.3 g |

The above weights are based on the weight of each component in 1000 gm of bath solution As previously noted, FX-661 is a preblended mixture of sulfonated Novolak resin and acrylic polymer. The major difference between the two formulations therefore is that Formulation A contains a soluble aluminum component and Formulation B does not.

The staining test results for the carpet samples treated with the stain blocker Formulation A are shown in Example 1. The results for the carpet treated with the stain blocker Formulation B are shown in Example 2.

TABLE II

| | Example 1 Formulation A | | Example 2 Formulation B | |
|---|---|---|---|---|
| | 1 Hour* | 8 Hour* | 1 Hour* | 8 Hour* |
| Original (Not Cleaned) | 7.5 | 6.5 | 7.0 | 6.0 |
| 1 Cleaning | 7.0 | 6.0 | 7.0 | 5.0 |
| 5 Cleanings | 7.0 | 5.0 | 6.0 | 4.0 |

*Time Kool-Aid solution remains on the test carpet

The above results show that for treated carpet samples which have not been cleaned with an alkaline detergent, stain blocking formulation A provides superior stain resistance. This superiority in stain resistance is evident whether the Kool-Aid solution remains on the carpet for one hour or for eight hours.

Where the treated carpet samples are subsequently cleaned with an alkaline detergent, stain blocking formulation A provides for a significant retention of stain resistance by the carpet. While there is a decrease in stain resistance by the carpet after one cleaning and especially after five cleanings, the decrease is not as great as that exhibited by the carpet treated with formulation B.

The above results strongly indicate the importance of having a soluble aluminum component in combination with the sulfonated phenolic resin and the acrylic polymer in order to impart to the carpet not only good original stain resistance but stain resistance durable to successive alkaline detergent washing.

The following examples 3–22 discuss carpets in which the stain blocker solution is applied by the alternative Exhaust Method. In the following examples, the stain test results are based on tests in which the pre-sweetened cherry flavored Kool-Aid solution remained on the test carpet sample for 24 hours.

COMPARATIVE EXAMPLES 3–8

Table III indicates some of the currently practiced or known treatments with stain blocker solutions for imparting stain resistant to fibrous polyamide substrates such as nylon carpets. It is noted that while sulfonated phenolic resin alone can impart satisfactory stain resistance, the combination of sulfonated phenolic resin and Leukotan™ 1027 can impart both satisfactory stain resistance and good lightfastness. This combination of sulfonated phenolic resin and Leukotan™ 1027 exhibits the best results for treated nylon carpets known in the industry.

TABLE III

| | 3 | 4 | 5 | 6 | 7 | 8 |
|---|---|---|---|---|---|---|
| Sulfonated Phenolic Resin | 1.5 g | .18 g | — | 1.5 g | .18 g | — |
| Leukotan ™ 1027 | — | 1.36 g | — | — | 1.36 g | — |
| FX-661 | — | — | 1.5 g | — | — | 1.5 g |
| $MgSo_4.7H_2O$ | — | — | — | 0.5 g | 0.5 g | 0.5 g |
| $Al_2(SO_4)_3.16H_2O$ | — | — | — | — | — | — |
| Stain Test (24 hours) | 5 | 5 | 1 | 4.5 | 5 | 4.5 |
| Lightfastness | 2 | 4–5 | 5 | 3 | 5 | 4–5 |

EXAMPLES 9–11

Example 3 is the control sample to which all the following treated carpet samples can be compared.

Example 9 of Table IV indicates that the combination of sulfonated phenolic resin and aluminum sulfate imparts very good stain resistance but poor lightfastness. Example 10 indicates that the combination of sulfonated phenolic resin, Leukotan™ 1027 and aluminum sulfate imparts both good stain resistance and excellent lightfastness. Example 11 indicates that the combination of FX-661 (a preblend of sulfonated phenolic resin and acrylic polymer) and aluminum sulfate similarly imparts good stain resistance and excellent lightfastness.

TABLE IV

| | 9 | 10 | 11 |
|---|---|---|---|
| Sulfonated Phenolic Resin | 1.5 g | .18 g | — |
| Leukotan ™ 1027 | — | 1.36 g | — |
| 3M Product FX-661 | — | — | 1.5 g |
| $MgSO_4.7H_2O$ | — | — | — |
| $AL_2(SO_4)_3.16H_2$ | 0.2 g | 0.2 g | 0.2 g |
| Stain Test (24 hours) | 7.5 | 7 | 6 |
| Lightfastness | 1 | 5 | 5 |

It is evident in the comparison of Examples 3–5 with examples 9–11 that the added component of a soluble aluminum compound such as aluminum sulfate to known treating solutions significantly improve stain resistance. Additionally, in comparing Examples 6–8 with Examples 9–11 the substitution of aluminum sulfate for magnesium sulfate significantly improves stain resistance. Where acrylic copolymers are present in the treating solution, this substitution results in the improvement in stain resistance without sacrificing excellent lightfastness characteristics.

EXAMPLES 12 AND 13

Examples 12 and 13 of Table V when compared to Example 10 show to what extent the aluminum sulfate component can be decreased while maintaining good stain resistance and lightfastness. No significant change in carpet characteristics is seen when aluminum sulfate is decreased from 0.2 gm to 0.13 gm. Degradation in stain resistance and lightfastness, however, is evident when aluminum sulfate is further reduced to 0.07 gm.

TABLE V

| | 12 | 13 |
|---|---|---|
| Sulfonated Phenolic Resin | .18 g | .18 g |
| Leukotan 1027 | 1.36 g | 1.36 g |
| 3M Product FX-661 | — | — |
| $MgSo_4.7H_2O$ | — | — |
| $AL_2(SO_4)_3.16H_2O$ | 0.13 g | 0.07 g |
| Stain Test (24 hours) | 7 | 5.5 |
| Lightfastness | 5 | 4–5 |

EXAMPLES 14–16

Comparison of Examples 14–16 in Table VI to Examples 6–8 in Table III indicate that when magnesium sulfate is decreased to the same level at which aluminum sulfate is effective in imparting stain resistance, there is reduced stain resistance and lightfastness characteristics observed for the carpet sample.

TABLE VI

| | 14 | 15 | 16 |
|---|---|---|---|
| Sulfonated Phenolic Resin | 1.5 g | .18 g | — |
| Leukotan 1027 | — | 1.36 g | — |
| 3M Product FX-661 | — | — | 1.5 g |
| $MgSO_4.7H_2O$ | 0.18 g | 0.18 g | 0.18 |
| $AL_2(SO_4)_3.16H_2O$ | — | — | — |
| Stain Test (24 hours) | 5.5 | 3.5 | 2 |
| Lightfastness | 2–3 | 4–5 | 4–5 |

EXAMPLES 17–20

Examples 17–20 in Table VII show that in the absence the sulfonated phenolic resin component, stain resistance is poor even when the treating solution contains Leukotan™ 1027, the combination of Leukotan™ 1027 and magnesium sulfate or the combination of Leukotan™ 1027 and aluminum sulfate.

TABLE VII

| | 17 | 18 | 19 | 20 |
|---|---|---|---|---|
| Sulfonated Phenolic Resin | — | — | — | — |
| Leukotan ™ 1027 | 1.5 g | 1.5 g | 1.5 g | 1.5 g |
| $MgSO_4.7H_2O$ | — | 0.5 g | 0.18 | — |
| $AL_2(SO_4)_3.16H_2O$ | — | — | — | 0.2 g |
| Stain Test (24 hours) | 2 | 2.5 | 2 | 1.5 |
| Lightfastness | 5 | 5 | 5 | 5 |

EXAMPLE 21

Wool articles can be treated with an aqueous solution of partially sulfonated phenolic resin; polymethacrylic acid, copolymers of methacrylic acid, or combinations of polymethacrylic acid and copolymers of methacrylic acid; and an effective amount of a soluble aluminum compound to improve stain resistance and lightfastness.

EXAMPLE 22

Wool articles can be treated with an aqueous solution of partially sulfonated phenolic resin and an effective amount of a soluble aluminum compound to improve stain resistance.

The compositions of the treating solutions and the methods of treating fibrous polyamide and wool articles as disclosed herein can be varied in a number of ways. The description is intended to illustrate the principle of using a soluble aluminum compound to increase stain resistance while maintaining excellent lightfastness. It is understood that changes and variations can be made therein without departing from the scope of the invention as defined in the following claims.

What is claimed is:

1. An improved method for treating a fibrous polyamide material comprising contacting the fibrous polyamide material with an aqueous solution comprising:

(a) a partially sulfonated novolak resin; and (b) a polymethacrylic acid, a copolymer of methacrylic acid, or a combination of said polymethacrylic acid and said copolymer of methacrylic acid, wherein the improvement comprises the presence of a water soluble aluminum compound within said aqueous solution.

2. A method for treating a fibrous polyamide material comprising contacting the fibrous polyamide material sequentially with the following solutions:

a) an aqueous solution comprising a partially sulfonated novolak resin;

b) an aqueous solution comprising a polymethacrylic acid, a copolymer of methacrylic acid, or a combination of said polymethacrylic acid and said copolymer of methacrylic acid; and c) an aqueous solution comprising a water soluble aluminum compound.

3. An improved method for treating a fibrous polyamide material comprising contacting the fibrous polyamide material with an aqueous solution comprising a partially sulfonated novolak resin, wherein the improvement comprises the presence of a water soluble aluminum compound in said aqueous solution.

4. A method for treating a fibrous polyamide material comprising contacting the fibrous polyamide material sequentially with the following solutions:

a) an aqueous solution comprising a partially sulfonated novolak resin; and b) an aqueous solution comprising a water soluble aluminum compound.

5. An improved method for treating a wool material comprising contacting the wool material with an aqueous solution comprising:

(a) a partially sulfonated novolak resin; and (b) a polymethacrylic acid, a copolymer of methacrylic acid, or a combination of said polymethacrylic acid and said copolymer of methacrylic acid, wherein the improvement comprises the presence of a water soluble aluminum compound within said aqueous solution.

6. A method for treating a wool material comprising contacting the wool material sequentially with the following solutions:

a) an aqueous solution comprising a partially sulfonated novolak resin;

b) an aqueous solution comprising a polymethacrylic acid, a copolymer of methacrylic acid, or a combination of said polymethacrylic acid and said copolymer of methacrylic acid; and c) an aqueous solution comprising a water soluble aluminum compound.

7. An improved method for treating a wool material comprising contacting the wool material with an aqueous solution comprising a partially sulfonated novolak resin, wherein the improvement comprises the presence of a water soluble aluminum compound within said aqueous solution.

8. A method for treating a wool material comprising contacting the wool material sequentially with the following solutions:

a) an aqueous solution comprising a partially sulfonated novolak resin; and b) an aqueous solution comprising a water soluble aluminum compound.

* * * * *